United States Patent [19]

Lincoln

[11] Patent Number: 5,033,118

[45] Date of Patent: Jul. 23, 1991

[54] SUN-SHIELDING VENTILATED SHIRT

[76] Inventor: Robert A. Lincoln, 8325 Murphy Rd., Laurel, Md. 20723

[21] Appl. No.: 506,095

[22] Filed: Apr. 9, 1990

[51] Int. Cl.[5] ..... A41B 1/00

[52] U.S. Cl. ..... 2/115; 2/113; 2/DIG. 1

[58] Field of Search ..... 2/115, 113, 46, DIG. 1

[56] References Cited

U.S. PATENT DOCUMENTS 3,122,754 3/1964 Wedin ..... 2/113

3,618,139 6/1970 Hugin ..... 2/115

*Primary Examiner*—Werner H. Schroeder

*Assistant Examiner*—Gloria Hale

[57] ABSTRACT

The shirt-like device disclosed shields the neck, shoulders, back, waist, and arms from rays of sunlight or radiation from the sun which may be harmful and provides for ventilation which makes the shirt-like device more comfortable to wear than an ordinary shirt in situations where it is hot and people ordinarily take off their shirts to be comfortable. The device protects those parts of the body that are likely to receive too much exposure to this radiation when people perform certain activities outdoors for long periods of time. The device fits over the upper body of a person. The sun-shielding part blocks, reflects, and/or impedes the rays of sunlight or radiation and covers those parts of the neck, shoulders, back, waist, and arms which receive the most exposure to sunlight when a person is engaged in activities which cause them to lean slightly forward or have their upper body horizontal. The sun-shielding portion is connected to a ventilated portion to form a complete shirt. The ventilated portion is designed to provide ventilation for the part of the body not covered by the sun-shield. The ventilated portion can be a system of bands, strings, strips, fish net material, or some other system for providing significant ventilation to the parts of the upper body not covered by the sun-shield.

6 Claims, 5 Drawing Sheets

SUN-SHIELDING VENTILATED SHIRT

BACKGROUND OF THE INVENTION

There are numerous types of shirts. Three of the most common types are shirts that button in the front of the wearer, those that button in the back of the wearer, and those that are pulled over the head of the wearer. These shirts may have various kinds of collars, cuffs, lengths, and sleeve lengths. They are made of a variety of materials. They may be made of various types of cloth, leather, plastic, or other materials. Some of the principal purposes of a person wearing a shirt are to provide warmth, to protect one from the wind, to protect one from the sunlight, to provide a fashionable cover for the upper part of the body, or just to cover the top part of the body so it isn't bare.

There are many times that people don't wear shirts. During these times the upper part of the body is exposed to the elements such as the wind, rain, or sunlight.

People often don't wear shirts when the temperature around them is hot. Some of these times are when these people are outdoors. During these times the unshirted upper part of the body would be exposed to sunlight. Some types of people who might not wear a shirt outside in hot weather and might stay in the sunlight for considerably long lengths of time are construction workers, farmers, and fishermen. Other shirtless people who might stay in the sunlight for considerably long periods of time are those engaged in games such as tennis or basketball.

There is now medical evidence that exposure of the skin to the sunlight for long periods of time causes skin to age prematurely and causes skin cancer.

The effect of sunlight on the skin of the human body is becoming increasingly more important as the atmospheric shield of the earth is becoming less effective in screening out harmful rays of light or radiation and such light or radiation reaches the surface of the earth and the people inhabiting it.

The reason the people mentioned above don't wear shirts is because wearing a shirt would cause their bodies to be hotter than they are without a shirt. If they wore a shirt they might get hot, sweat, and be uncomfortable. In the past, many of them have probably not even considered that they were exposing their bodies to the harmful rays of the sun. In fact, many of them probably wanted to expose their bodies to the sunlight thinking that it was good for them, or they may have wanted to get their bodies to have a tan color.

The people who believed too much sunlight was a danger might wear a shirt if they had a shirt that protected them from the sunlight and did not cause their bodies to get excessively hotter. My invention is such a shirt.

The sunlight does not strike all parts of the upper body for an equal time or in the same manner. The back and sides of the neck, the shoulders, the outside or back portions of the arms, the back, and the waist are exposed to the direct light of the sun more of the time than is the rest of the upper body. This is because the people mentioned above usually have their upper body bent forward when they are engaged in the activities mentioned. The sunlight is striking their chests, the inside of their arms, and the front of their necks less of the time, and it is hitting these parts indirectly (reflected light) or it is hitting these parts at angles which lessen the harmful effect of the rays.

SUMMARY OF THE INVENTION

My invention is a device or shirt which protects parts of the upper body from the light or radiation of the sun while at the same time it keeps the person wearing the shirt from getting excessively hotter; because, it allows much of the heat coming out of the upper body to escape, and disallows heat from the sun to be absorbed by the parts of the upper body which are covered. The invention allows one to have ventilation for that part of the body surface which is not exposed to as great an amount of direct sunlight (when a shirt is not worn) while at the same time it protects the back of the neck, the back, and other parts of the body which would be exposed to greater amounts of direct sunlight (when a shirt is not worn).

My invention utilizes a fabric, reflective film, or other material which is capable of blocking, resisting, or reducing the passage of sunlight to cover portions of the upper body and arms. The parts covered may vary depending on the extent considered necessary to achieve the ventilation desired while taking into consideration which portions of the upper body one wishes to protect and the degree of protection one wishes to provide. The other portions of the upper body would be left uncovered, except to the extent necessary to form an attachment system for the material that is to cover those portions that are to be covered. Thus, intermittent bands or strips of material could come accross the front of the chest, or a mesh or fishnet fabric could cover those portions of the body that are not to be protected. When the temperature of the air around the body is less than body temperature, some material which is a good conductor of heat could be utilized in the construction to conduct heat away from the body, and thus supplement the cooling allowed by the ventilation.

DESCRIPTION OF THE PREFERRED EMBODIMENTS

Figure 1:
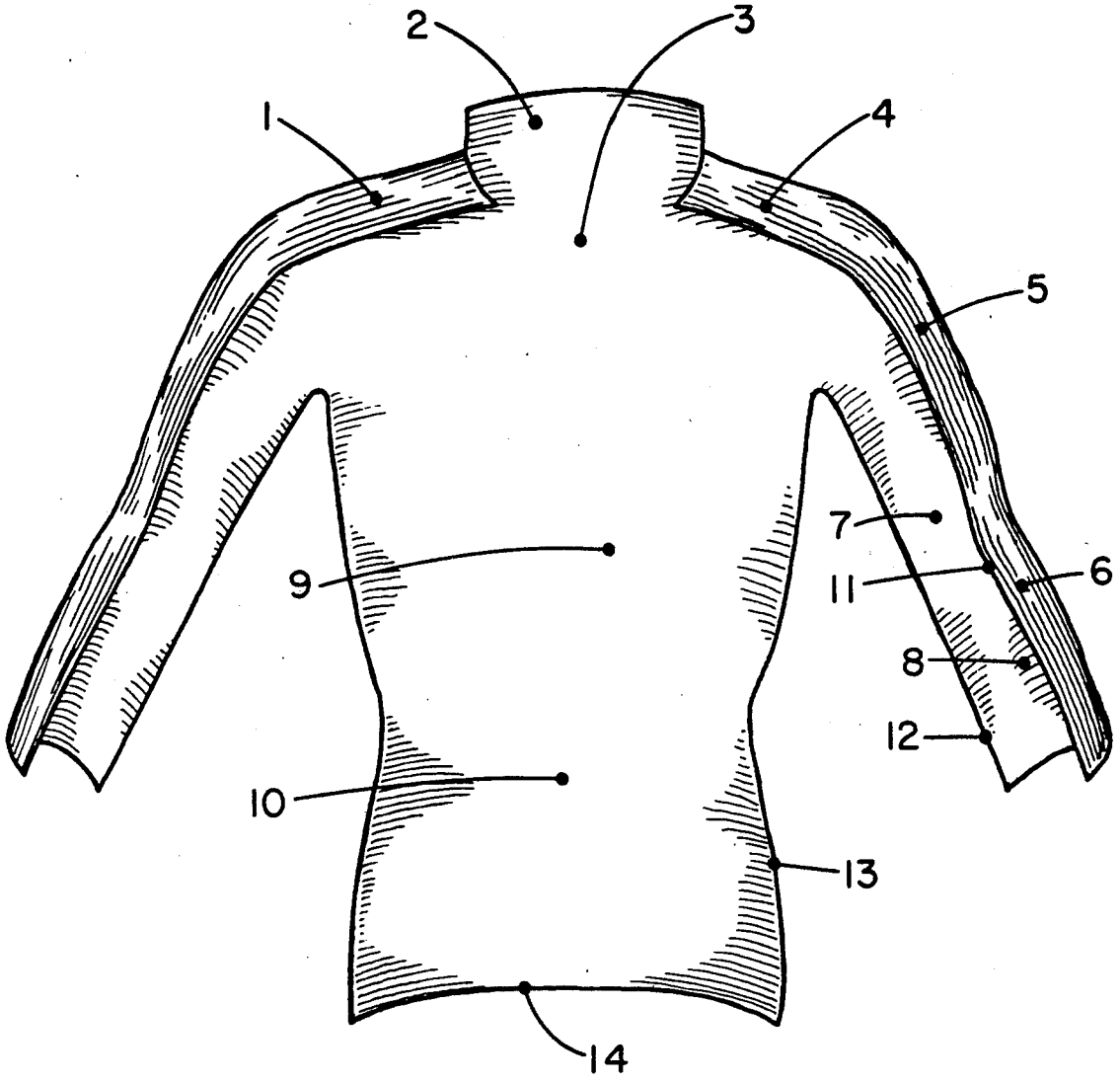
FIG. 1 is a front view of the preferred embodiment of the sun-shielding portion of the device in accordance with my invention. The device is being viewed as if looking at the wearer's face and chest and the wearer not being shown or the wearer being invisible, and light shining from and on the inside of the device where the wearer would be found.

Referring to FIG. 1, a sun-shielding device which is to be worn to cover the neck, shoulders, arms, back and waist of a person. The device protects these areas of the body from the sun's rays or radiation. The device is made of a material which reflects, blocks and/or impedes the sun's rays or radiation. The device includes an inside, shown as unshaded, which lays against the skin or body of the wearer 1 and an outside, partially shown, and where shown, being shown as the shaded area, which would be exposed to the sunlight. The inside and outside are opposite sides of a sheet of the sun-shielding material of which the device is made. The best materials for the composition of the device are lightweight and tightly woven nylon, rayon, or polyester cloths which block the passage of sunlight and billow like a sail with the slightest breeze; or, a looser weave which blocks or impedes the passage of sunlight, but allows some air flow through the cloth.

Areas 1 and 4 cover the top of the shoulders, area 5 covers one side of the upper arm and area 6 covers one side of the lower arm. These arms 1, 4, 5 and 6 are shaded as they are on the outside of the device as it is shown where it wraps over the outer side of the wearer's arms and over the shoulders so as to be visible in this front view. Area 2 covers the neck and extends up from the top of the shoulders approximately 2 inches, about to the hairline on the back of the neck, and wraps around the sides of the neck to points just below the location of the ears when the head is facing forward. Area 3 covers the top of the back, area 9 covers the middle of the back, and area 10 covers the lower back and waist. Area 7 covers the back of the upper arm and area 8 covers the back of the lower arm or forearm.

Edge 11 of the arm covering areas runs approximately on a line on the front part of the arm where a borderline would be formed between where sunlight is striking the arm and not striking the arm along its length when the light is coming directly from the side of the wearer and the palm side of the wearer's hand is toward the side of the wearer's upper leg.

Edge 12 of the arm covering areas runs approximately on a line on the back part of the arm where a line would be formed where the back of the arm along its length just begins to touch the trunk of the body when the arm is held straight down and stretched against the side of the trunk of the body with the palm of the hand held against the side of the upper leg.

Edge 13 of the back and waist covering areas runs approximately on a line adjacent to that of edge 12, or where a line would be formed where the back of the arm along its length just begins to touch the trunk of the body when the arm is held straight down and stretched against the side of the trunk of the body with the palm of the hand held against the side of the upper leg. This edge 13 can also be described as located adjacent to that part of the body where the sides of the trunk of the upper body turn inward toward the front of the chest and are no longer hit by direct sunlight when the sunlight is coming from behind the back of the person. The exact location of this edge 13 is not too critical, as the side of the trunk of the body is somewhat shielded by the hanging arms as they move about. Also, when sunlight is coming from the side and the arms are not in position to shield the sides of the upper body, the light rays are hitting the part of the body in front of this edge 13 at angles with the body of much less than 90 degrees and their harmful effect is diminished. One should notice that the farther toward the back this edge is located, the greater the area available for ventilation.

Edge 14 is the bottom edge of the device and is located just below the beltline of the wearer. This length below the top of the wearer's pants provides coverage for the waist when the wearer bends forward.

Not shown on the drawing, but which could be added to the device to provide ventilation between the body and the sun-shield, are ridges of some material wherein the ridges run parallel to edge 12 on the arm covering part and parallel to edge 13 on the body trunk covering part. These ridges would leave valleys or open space between the sun-shield and the body and air could flow through them to carry away heat being built up there. However, it is not believed this extra construction detail would ordinarily be needed, as the looseness of the shirt should allow this type of ventilation to occur.

Figure 2:
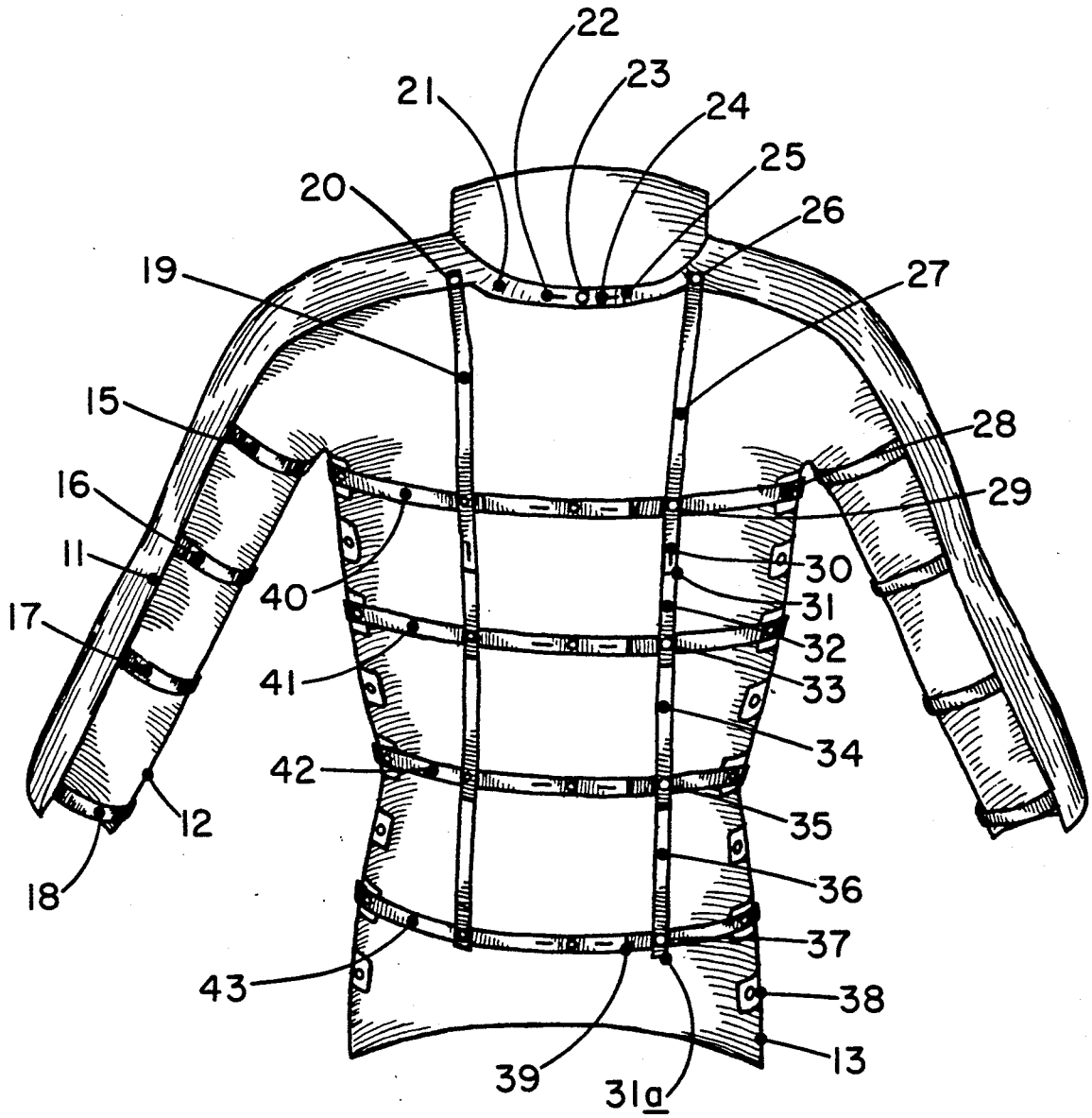
FIG. 2 is a front view of a preferred embodiment of the entire device. It is being viewed as if looking at the wearer's face and chest and the wearer not being shown or the wearer being invisible; and, at the same time. light shining from the inside of the device. It also shows the addition of adjustable bands going accross the wearer's chest and waist, and other bands going around the wearer's arms—the bands and the adjustable bands acting in combination with the sun-shielding portion to form a means of securing the device on the wearer.

Referring now to FIG. 2, showing the sun-shielding device of FIG. 1 enhanced by a ventilated portion which is here shown to be a system of cloth bands which, together with the sun-shielding portion, comprise a sun-shielding ventilated shirt of my invention.

Bands 15, 16, 17, and 18 join the front edge 11 and back edge 12 of the arm covering part of the shield and secure the shield to the arms. These bands can be made of an elastic material to hold the shield more tightly on the arms. However, a looser fit which will allow air to circulate under the shield will provide additional ventilation and will be cooler.

Bands 19 and 27 are two vertical bands which connect, with buttons 20 and 26, to the areas of the sun-shield which cover the top of the shoulders. The vertical bands also connect to horizontal band 40, which goes accross the chest, and horizontal bands 41, 42, and 43, with buttons such as buttons 29, 33, 35, and 37. Additional buttonholes in bands 19 and 27, such as buttonhole 30, allow band 40 to be moved to an alternate position of attachment with the edges of the shield. (The buttonholes are in the bands shown on top at the button locations, and more than one band can be using the same button. For example, bands 34 and 36 are both using button 35.)

Horizontal band 21 is in 2 parts and goes accross the chest at the base of the neck and the left part attaches to the other part with button 23. Buttonholes 22 and 24 provide for adjusting the length of band 21. Like buttonholes and buttons on bands 40, 41, 42, and 43 permit the adjustment of the length of these bands.

Ends 25 and 39 are the ends of the left part of bands 21 and 43 and are the same as the ends of the left part of bands 40, 41, and 42 as they overlap the right part of the bands. Similarly, end 31 of vertical band 27 depicts the overlap of band 27 over band 32. Likewise, band 32 overlaps band 34 and band 34 overlaps band 36. End 31*a* of band 36 is similar to end 31 of band 27.

Each of the vertical bands 32, 34, and 36 is connected to two horizontal bands by buttons such as button 35 and button 37 which are connectors for band 36 and connect band 36 to horizontal bands 42 and 43.

Horizontal bands 40, 41, 42, and 43 are attached to the left and right vertical edges of the sun-shielding portion with buttons, such as button 28, on points of attachment, such as the point of attachment with button 28 on it, or alternate points of attachment, such as point of attachment 38 on edge 13, which are incorporated into the vertical edges of the sun-shielding portion of the invention. Alternate points of attachment, such as 38 on edge 13, are provided to allow the horizontal bands 40, 41, 42, and 43 to be moved to them and to provide a place where a breast covering portion can be added for women.

Horizontal band 21 has no button-type points of attachment at its extremeties because the ends of the band are incorporated into the shoulder covering areas of the sun-shielding portion.

Figure 3:
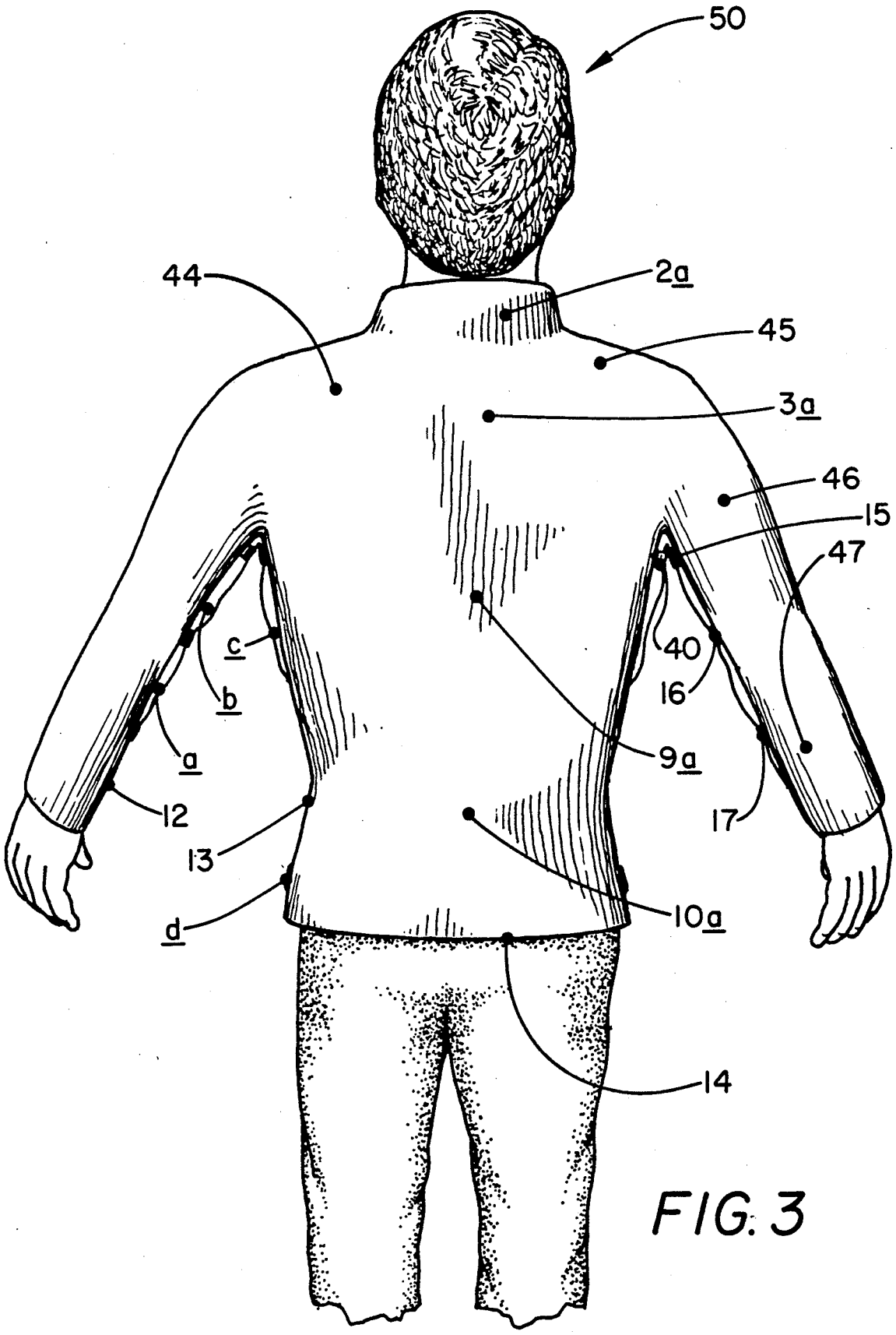
FIG. 3 is a back view of a man wearing an exemplary sun-shielding ventilated shirt of the present invention. The outside of the device is being viewed, and this is the side that would be toward the sun.

Turning to FIG. 3, the exemplary sun-shielding ventilated shirt is shown being worn on the back of the upper body of a male user 50. The outside of the sun-shielding portion is shown. Areas 2*a*, 3*a*, 9*a*, and 10*a*, are the outside areas of the device which coincide with the inside areas 2, 3, 9, and 10 shown in FIG. 1. Areas 44 and 45 cover the back part of the shoulders while area 46 covers the back of the upper arm and area 47 covers the back of the forearm.

Edge 12 runs along the back part of the arm and edge 13 runs along the side of the trunk of the upper body. Edge 14 is just below the wearer's belt d.

Bands 15 and 16 go accross the upper arm while band 17 is shown going accross the forearm. Band 40 is shown coming around the side of the body to maintain its attachment to the sun-shielding portion.

When the arms are held out away from the body, as shown in FIG. 3, it is likely, with some people, that part of the forearm a, the upper arm b, and the *teres major* and *latissimus dorsi* muscles c would be visible, as shown.

Figure 4:
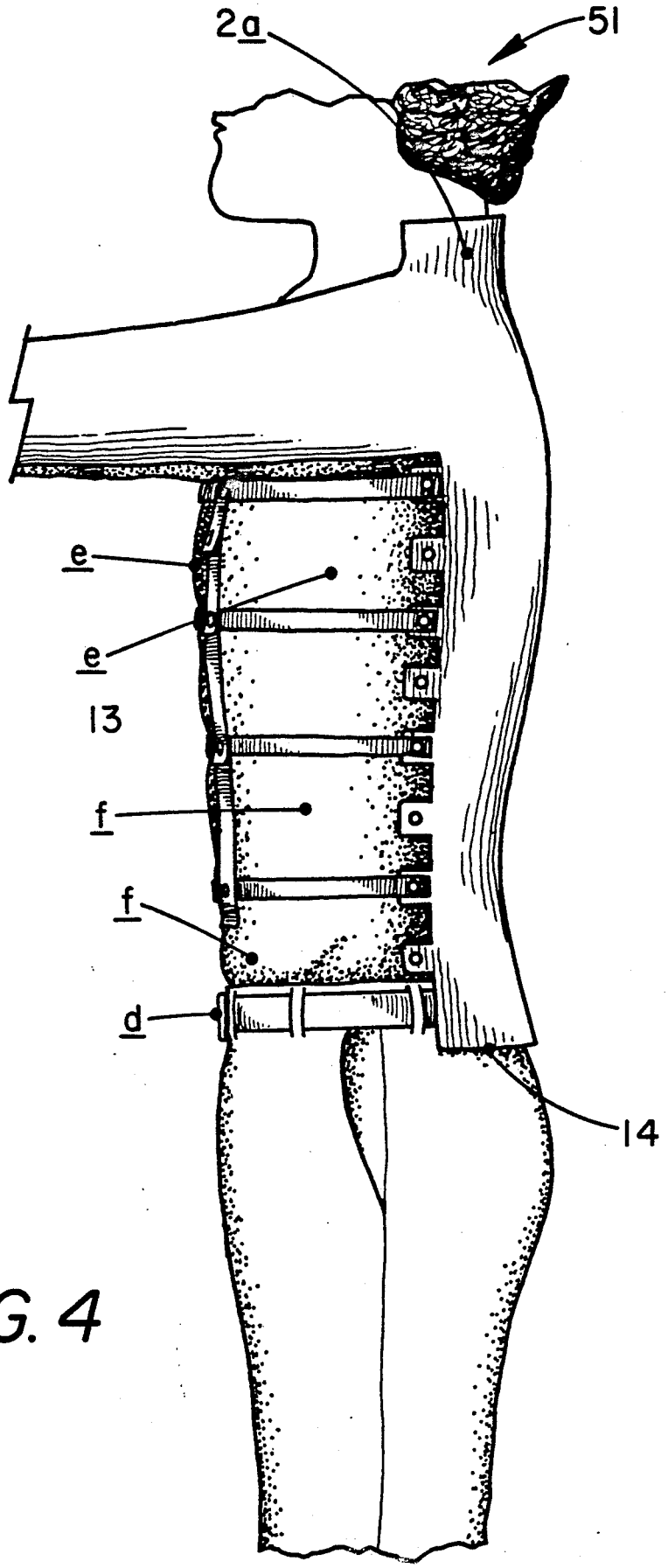
FIG. 4 is a side view of a man wearing an exemplary sun-shielding ventilated shirt of the present invention. The outside of the device is being viewed and is the side that would be toward the sun. The arms of the person are extended forward to allow the entire side of the body to be viewed.

Turning now to FIG. 4, a side view of the exemplary sun-shielding ventilated shirt is shown being worn on the upper body of a male user 51. The outside of the shirt is shown. Edge 13 is adjacent to that part of the body where the sides of the trunk of the upper body turn inward toward the front of the chest and are no longer hit by direct sunlight when the sunlight is coming from behind the back of the person. The bottom or horizontal edge 14 is just a few inches below the belt d. Parts of the chest e and of the stomach f are uncovered except for that area which is under the bands. The arms are shown extended forward so the exposed side can be viewed; however, during normal usage the arms will be hanging at the wearer's sides most of the time and they will be protecting the uncovered sides from the sun's direct rays. Area 2*a*, as shown in FIG. 3, is shown here covering the side of the neck.

Figure 5:
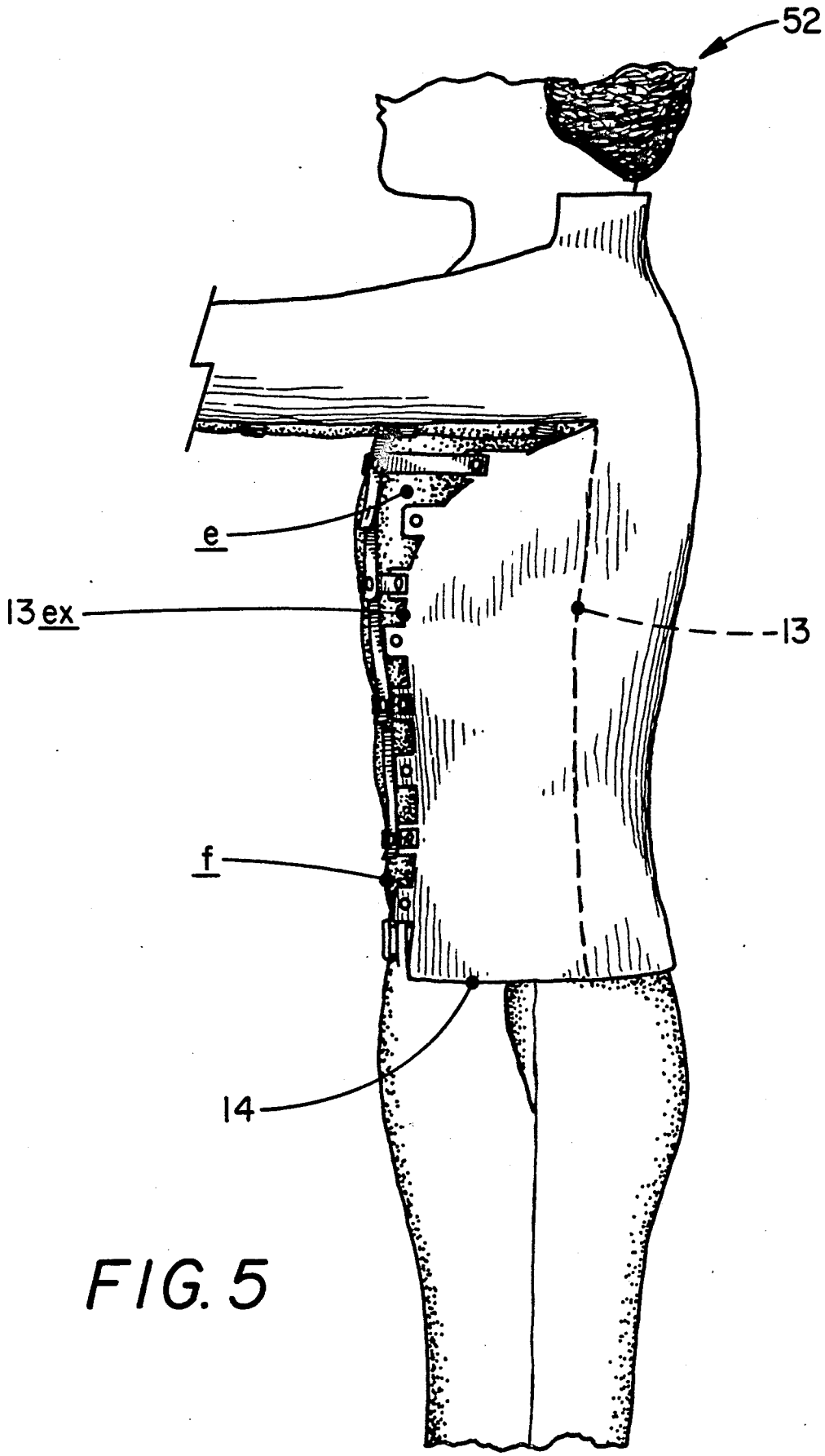
FIG. 5 is a side view of a man wearing an exemplary sun-shielding ventilated shirt of an alternative design of the present invention. The outside of the device is being viewed and is the side that would be toward the sun. The device is shown in its alternative design which is to provide sun-shielding protection for the side of the trunk of the upper body in situations where the arms are not hanging at the side of the body and are not providing that protection.

Referring finally to FIG. 5, a side view of an alternative design of the exemplary sun-shielding ventilated shirt is shown being worn on the upper body of a male user 52. The outside of an alternative design of the shirt is shown. The location of edge 13 as shown in FIG. 1, FIG. 2, FIG. 3, and FIG. 4 is depicted here with a broken line; that would be the edge of the sun-shielding portion when the shirt is used for protection in situations where the arms are usually hanging at the side of the body and providing sun-screening protection for the side of the body. However, in situations where the arms are not at the sides of the body, such as when outstretched while the person is standing, or hanging down or outstretched while the person is kneeling, sun-shielding protection for the sides of the trunk of the upper body must be provided by extending the sun-shielding portion of the shirt around part of the sides of the body. Edge 13*ex* is the vertical edge of the sun-shielding portion of the alternative design which is to provide this protection. The straight part of edge 13*ex* is located on the body along that line where sunlight coming from above and to the side of the person would no longer directly (as opposed to indirect or reflective light) strike the side or front of the upper body when the person's upper body is horizontal or where the upper part of the body is parallel to the circumference of the earth and the arms are not blocking the sunlight which is to strike the subject part of the body. The approximate location of edge 13*ex* on the body can also be determined by standing with light coming directly from the side, and with the arms hanging downward and held with the palms of the hands against the side of the legs, note where the shadow from the arm is located on the front-side of the upper body. The edge of the shadow would be the approximate location of the straight part of edge 13*ex*. Edge 14 remains at the same height or length for the alternative design as it is for the other design. Although vertical bands are shown going over the chest on the alternative design, note that the distance accross the chest between the two vertical edges is reduced sufficiently so that vertical bands are not needed to hold the horizontal bands in place.

Uncovered chest e and stomach f are also shown with the ventilated portion of the shirt going accross them.

It is to be understood that the foregoing description relates to exemplary embodiments and variants of my invention set out by way of example, not by way of limitation. Numerous other embodiments and variants are possible without departing from the spirit and scope of the invention, its scope being defined in the appended claims.

I claim:

1. A sun-shielding ventilated shirt comprised of a sun-shielding portion made of material which impedes the passage of light and radiation from the sun and being sized and shaped to cover the back areas of a person's neck, shoulders, back, sides, waist, and arms, top areas of the shoulders, and part of the side areas of the neck, arms, and shoulders; and a ventilated portion, which in combination with the sun-shielding portion, holds the sun-shielding portion on the areas of a body covered by it, and such ventilated portion being a system of thin bands of material crossing over the front side of the sun-shielding portion and connected together and connected to the edges of the sun-shielding portion, whereby, when the sun-shielding ventilated shirt is worn by a person, the system of thin bands of material connected to the edges of the neck, back, and shoulder covering portion of the sun-shielding portion cross over the front and sides of the chest, waist, and stomach, and the system of thin bands of material connected to the edges of an arm covering portion of the sun-shielding portion cross over the front and inside areas of the arm.

2. A sun-shielding ventilated shirt according to claim 1 wherein the ventilated portion is a system of strings or strips of material crossing over the front side of the sun-shielding portion and connected to the edges of the sun-shielding portion.

3. A sun-shielding ventilated shirt according to claim 1 wherein the ventilated portion is a string fabric, with spaces between the strings being at least one-half inch wide in all directions, crossing over the front side of the sun-shielding portion and connected to the edges of the sun-shielding portion.

4. A sun-shielding ventilated shirt comprised of a sun-shielding portion made of material which impedes the passage of light and radiation from the sun and being sized and shaped to cover the back areas of a person's neck, shoulders, back, sides, waist, and arms, top areas of the shoulders, and part of the side areas of the chest, stomach, waist, neck, arms, and shoulders; and a ventilated portion, which in combination with the sun-shielding portion, holds the sun-shielding portion on the areas of a body covered by it, and such ventilated portion being a system of thin bands of material crossing over the front side of the sun-shielding portion and connected together and connected to the edges of the sun-shielding portion, whereby, when the sun-shielding ventilated shirt is worn by a person, the system of thin bands of material connected to the edges of the neck, sides, and shoulder covering portion of the sun-shielding portion cross over the front and sides of the chest, waist, and stomach, and the system of thin bands of material connected to the edges of an arm covering portion of the sun-shielding portion cross over the front and inside areas of the arm.

5. A sun-shielding ventilated shirt according to claim 4 wherein the ventilated portion is a system of strings or strips of material crossing over the front side of the sun-shielding portion and connected to the edges of the sun-shielding portion.

6. A sun-shielding ventilated shirt according to claim 4 wherein the ventilated portion is a string fabric, with spaces between the strings being at least one-half inch wide in all directions, crossing over the front side of the sun-shielding portion and connected to the edges of the sun-shielding portion.

* * * * *